United States Patent [19]

Jacobo et al.

[11] 4,155,552

[45] May 22, 1979

[54] DUMBBELL SHAPED PROJECTILE AND BALLOON TARGET GAME

[76] Inventors: Emilio Jacobo, c/o George Spector, 3615 Woolworth Bldg., 233 Broadway; George Spector, 3615 Woolworth Bldg., 233 Broadway, both of New York, N.Y. 10007

[21] Appl. No.: 854,585

[22] Filed: Nov. 25, 1977

[51] Int. Cl.[2] ..... A63B 63/04; A63B 65/00; F41J 1/00

[52] U.S. Cl. ..... 273/101; 273/106 R; 124/5; 273/102.1 B; 273/102 AF

[58] Field of Search ..... 46/88, 87; 273/101, 273/102 R, 102 AF, 96 R, 102.1 R, 102.1 B, 106 R; 124/5

[56] References Cited

U.S. PATENT DOCUMENTS

| | | | |
|---|---|---|---|
| 1,394,277 | 10/1921 | Chester | 273/86 R |
| 1,507,505 | 9/1924 | Munn | 273/86 R |
| 2,002,631 | 5/1935 | Fiondella | 124/5 |
| 2,153,976 | 4/1939 | Thorman | 273/102 R |
| 3,092,388 | 6/1963 | Wagenheim | 273/102.1 B |
| 3,711,096 | 1/1973 | Cramp et al. | 273/106 R |

FOREIGN PATENT DOCUMENTS

| | | | |
|---|---|---|---|
| 333468 | 2/1921 | Fed. Rep. of Germany | 124/5 |

*Primary Examiner*—Richard C. Pinkham
*Assistant Examiner*—Lawrence E. Anderson

[57] ABSTRACT

A competitive game in which each player holds a tong used to throw a dumbbell-shaped projectile toward a target that includes a flat vertical backwall in front of which serval inflated, conventional rubber balloons are supported in front of points of spikes extending forwardly through the backwall, so that when the projectile successfully strikes a balloon and pushes it backwards against the spike point, the balloon is exploded.

2 Claims, 6 Drawing Figures

DUMBBELL SHAPED PROJECTILE AND BALLOON TARGET GAME

This invention relates generally to competitive action games of skill.

A principal object of the present invention is to provide a game in which a player's skill to aim is used in tossing a dumbbell-shaped projective toward inflated rubber balloons so to push the balloons against a spike point so to cause the balloon to break thereagainst.

Another object is to provide a twin ball game in which each balloon is identified with a scoring value so that score can be played between competitive players in order to determine a winner.

Still another object is to provide a twin ball game which provides diversion and entertainment while giving a healthful excercise and developing a person's skill in aiming.

Other objects are to provide a twin ball game in which is simple in design, inexpensive to manufacture, rugged in construction, easy to use and efficient in operation.

These and other objects will be readily evident upon a study of the following specifications and the accompanying drawing wherein.

Figure 6:
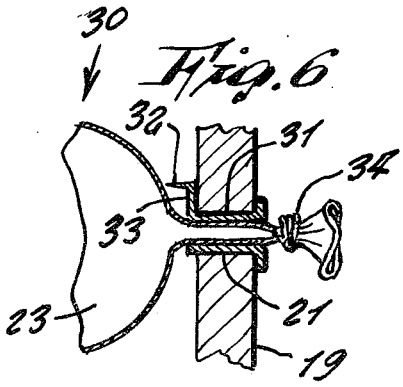
Figure 5:
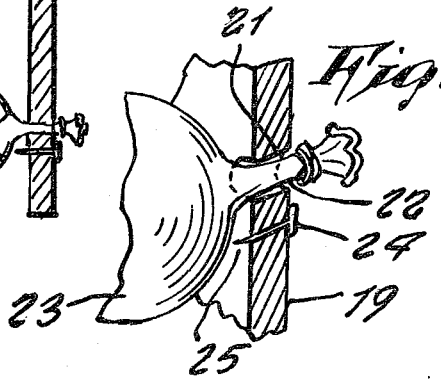
FIG. 5 is an enlarged detail thereof so to more clearly show the parts.

FIG. 6 is a view generally a same as FIG. 5 and showing a modified construction in which a freely rotatable collar extends through a hole in the board; the ballon neck extending through a collar, and a forward edge of the collar having a pointed spike formed thereon, so that the collar can be set to have the spike either above or below the hole, whereby if the missile deflects a balloon downward when the spike is above, then the ballon will not puncture; thus making the game more difficulty.

Refering now to the drawing in greater detail, and more particulary to FIGS. 1 to 5, the reference numeral 10 represents a twin ball game in which a pair of tongs 11 held in a hand of each player is used to toss a dumbell-shaped projectile 12 against one of the targets 13 some eighteen feet away.

The pair of tongs 11 is comprised of a scissors-like unit made of crossing layers 14 pivoted on a rivet 15. A jaw 16 at one end for grasping the projectile, including a notch 17 on one jaw member so to grip the central stem 18 of the projectile 12. A rounded head is at each end of the stem.

The target includes a flat panel 19 measuring twelve by sixteen inches, and having a looped thong 20 at its upper end for hanging up vertically on a wall nail. Five holes 21 drilled through the panel, each receives a neck 22 of an inflatable rubber balloon 23 positioned in front of the panel. A nail or spike 24 extends through the panel, has a pointed end 25 behind the balloon so that it punctures the balloon when the projectile pushes the balloon thereagainst. The target panel 19 may be mounted on wire screen, fence or the like as indicated at 13*a*.

Each balloon is a different color, and each balloon is nemerically designated by a number on the panel, as shown at 26, so to be used in a scoring value when caused to be punctured by the projectile.

Figure 1:
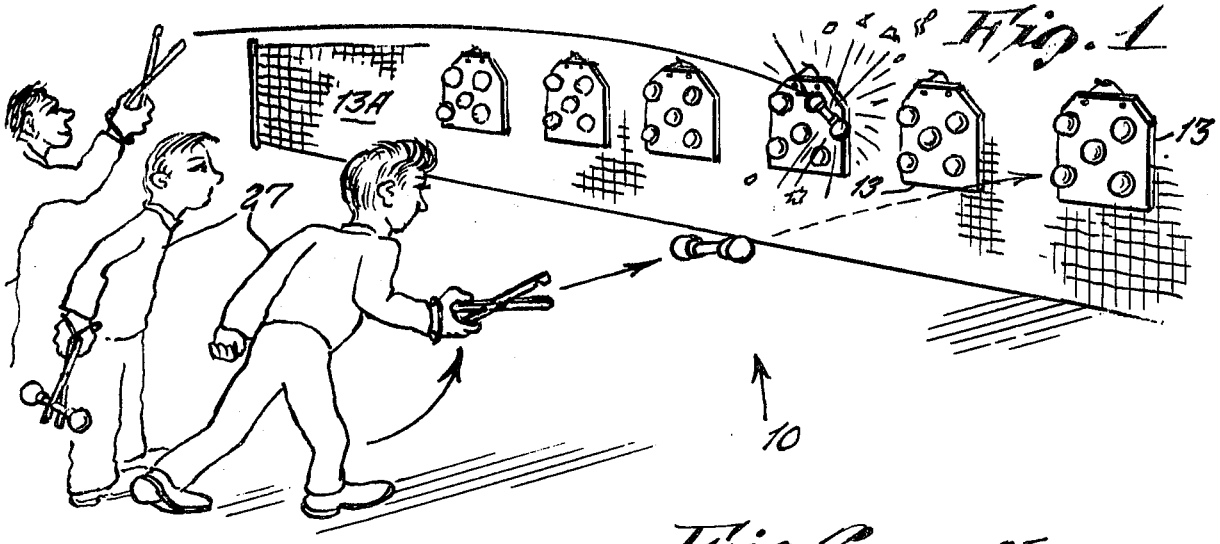
FIG. 1 is a perspective view of game competitively played and utilizes the components of the present Invention.
Figure 2:
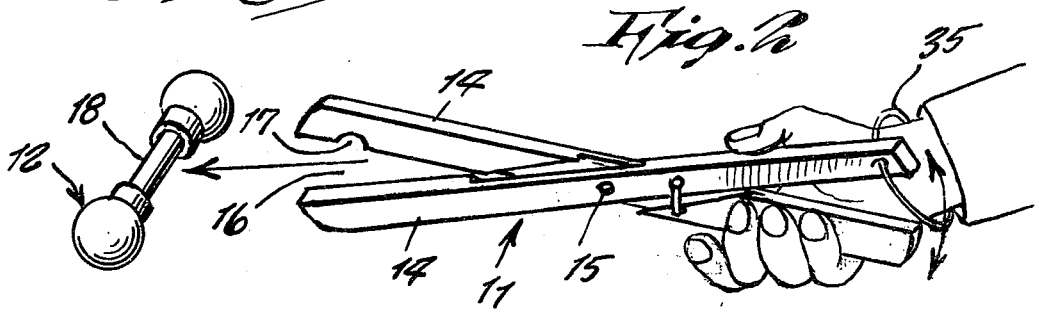
FIG. 2 is a perspective view of the tongs shown releasing the missile.
Figure 3:
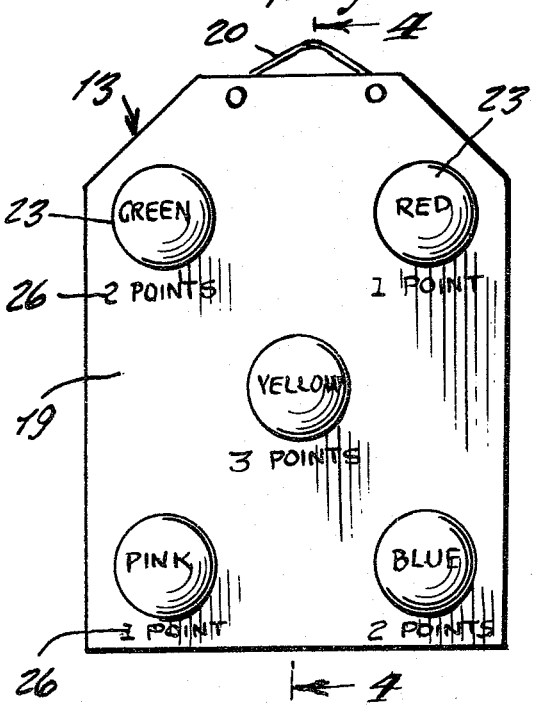
FIG. 3 is a front view of the target board with ballons attached thereto.
Figure 4:
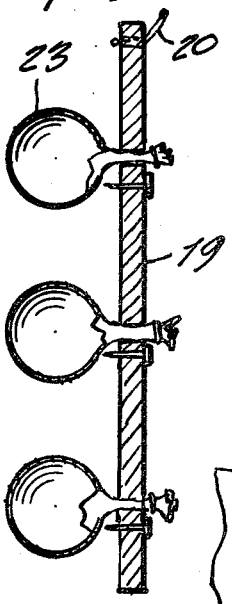
FIG. 4 is a side cross sectional view on line 4—4 of FIG. 3.

In playing the game, serval players 27 are each equipped with a pair of tongs and projectile for throwing toward their own individual target, as shown in FIG. 1. The game may be played with various rules, as wished, such as for example: a first player who achieves a certain score total is declared a winner. Or the game can be played in teams of three players, each, and who play the game up to twelve innings. The game can be played by youths as well as grown-ups, and can include women as well as men.

In FIG. 6, a modified design 30 of the Invention uses a sleeve 31 fitted rotatably in each hole 21; the sleeve being integral with a sharp point 32 on a radial arm 33 of a forward end thereof for piercing the balloon. This design permits rotating the sleeve so that the point may be altered in position, above, below or to either side of the hole. If the same is positioned by another person than a player, such or by a competitor, then the player does not know whether to try to strike the balloon by the projectile in either of these directions so that the balloon is impalled on the point. Thus this gives a greater challenge for success by the players. In use the balloon neck extends to a rear of the panel where a string 34 ties the balloon from deflating. A thong 35 holds the tongs around a player's wrist, to prevent the tongs from being released along with the projectile.

While various changes may be made in the detail construction, it is understood that such changes will be within the spirit and scope of the present invention as in defined by the appended claims.

What is claimed is:

1. A twin ball game, comprising in combination, a tong and a dumbbell-shaped projectile tossed by the player by means of the tong, including a target toward which said projectile is aimed, said tong being comprised of pivoted crossing levers forming jaws at one end to hold said projectile therebetween during a launching thereof, said target including a vertical flat panel supporting a plurality of similar spaced horizontal inflated rubber balloons on its front side, each balloon being positioned in front of a horizontally projecting point for being impalled thereupon, including a hole in said panel behind each said balloon for the neck of each said balloon to extend therethrough and being tied against deflation, said point being movably mounted on said panel whereby said point can be positioned at various locations.

2. The combination as set forth in claim 1, wherein a freely rotatable sleeve is mounted in each said hole, said projecting point being on a sideward arm integral with a forward end of said sleeve.

* * * * *